US006200083B1

(12) United States Patent
Hein

(10) Patent No.: US 6,200,083 B1
(45) Date of Patent: Mar. 13, 2001

(54) ARTICULATED BUCKET ADAPTED FOR A FORK-LIFT TRUCK

(76) Inventor: Richard Hein, 3107-41 Street SE., Calgary, Alberta (CA), T2B 1E6

( * ) Notice: Subject to any disclaimer, the term of this patent is extended or adjusted under 35 U.S.C. 154(b) by 0 days.

(21) Appl. No.: 09/289,141

(22) Filed: Apr. 8, 1999

(51) Int. Cl.[7] ..... B66F 9/12
(52) U.S. Cl. ..... 414/607; 414/642; 414/723
(58) Field of Search ..... 414/607, 640, 414/642, 722, 723, 912; 37/903

(56) References Cited

U.S. PATENT DOCUMENTS

| | | | | |
|---|---|---|---|---|
| 2,482,692 | * | 9/1949 | Quales et al. | 414/607 |
| 2,679,330 | * | 5/1954 | Allen | 414/642 |
| 2,917,196 | * | 12/1959 | Hastings, Jr. | 414/642 |
| 3,032,220 | * | 5/1962 | Love | 414/640 X |
| 3,034,237 | * | 5/1962 | Wolfe et al. | 414/723 X |
| 3,270,900 | * | 9/1966 | Sherman | 414/607 X |
| 3,498,489 | * | 3/1970 | Love | 414/607 |
| 3,971,485 | | 7/1976 | Hoppey . | |
| 4,408,946 | | 10/1983 | Haven et al. . | |
| 4,545,721 | * | 10/1985 | Pettersson | 414/607 X |
| 4,798,510 | | 1/1989 | Lazenby . | |
| 4,838,752 | | 6/1989 | Bryant . | |
| 4,987,631 | | 1/1991 | Eaglesham . | |
| 5,054,150 | | 10/1991 | Best et al. . | |
| 5,114,296 | | 5/1992 | Badder . | |
| 5,531,036 | | 7/1996 | Shinkle . | |
| 5,560,129 | | 10/1996 | Rothbart . | |
| 5,655,873 | | 8/1997 | Jobmann et al. . | |
| 5,779,430 | * | 7/1998 | Ball | 414/607 X |

* cited by examiner

*Primary Examiner*—James W. Keenan
(74) *Attorney, Agent, or Firm*—Gene Scott; Patent Law & Venture Group

(57) ABSTRACT

An attachment for a forklift truck comprising an articulated bucket, hydraulic ram and pallet-like platform for engagement with the forks of the truck. By using the existing hydraulic lines of the truck the bucket may be actuated between a horizontal and a dump positions. The ram is positioned medially on the bucket and a gusset plate is employed within the bucket to enable the forces to be distributed to the bucket plates in an even manner and so that the assembly may be constructed with plates of less weight.

4 Claims, 3 Drawing Sheets

ARTICULATED BUCKET ADAPTED FOR A FORK-LIFT TRUCK

BACKGROUND OF THE INVENTION

1. Field of the Invention

This invention relates generally to front loading machines, and more particularly to a hydraulically articulated bucket mounted onto a pallet like platform which may be engaged by a forklift truck for employment as a front loader.

2. Description of Related Art

The following art defines the present state of this field:

Badder, U.S. Pat. No. 5,114,296 describes an assemble detachably mountable on the forks of a fork-lift vehicle includes a frame having channels open at one end thereof for insertion there-into of respective ones of the forks of a fork-lift vehicle. A bucket having a bottom wall and an open front wall is tiltably attached to the frame for movement from one to the other of load holding and load dumping positions. Located at the open front wall of the bucket is a door movable mounted there on, which is movable to open and close the open front wall. The assembly also includes poser units, which can selectively move the bucket relative to the frame and open and close the door. The assembly can be used with a conventional forklift vehicle to scoop up particulate material form a surface, and carry the material to another location where it can be dumped from the assembly.

Rothbart, U.S. Pat. No. 5,560,129 describes an attachment for a forklift truck to facilitate the removal or clearing of snow or other materials and debris with the truck, including a frame having two rectangular elongated tubes adapted to receive the tines of the forklift, a plurality of transversely extending crossbars connecting said tubes together, ground-engaging members attached to each tube, a plow blade pivotally attached to the frame, and a shear pin assembly connected between the blade and the frame preventing uneven ground and/or obstruction on the ground from damaging the blade.

Shinkle, U.S. Pat. No. 5,531,036 describes a plow attachment for a forklift vehicle that has elongated cavities extending from the rear-side of the scrapper blade to receive the lift arms of the forklift vehicle. A connecting link is used to hold the plow attachment includes adjustable elements that permit the plow attachment to be mounted on the lift arms at an angle.

Haven et al., U.S. Pat. No. 4,408,946 describes an application disclosing a design for an automatically dumping hopper for use with a forklift. The hopper is designed for a 1-man operation with the operator transporting stacking and dumping the hopper without leaving the forklift seat and without the use of any controls other than the controls of the forklift. Two embodiments of the invention are disclosed. One embodiment which is useful for sand, gravel and other loose bulk material has a hinged bottom secured to the side-walls with a hasp latch constructed such that when the hopper is tilted on edge, the hasp clears from its retainer, releasing the bottom to open when the hopper is lifted. The latch only releases upon tilting of the hopper so that the hopper cab be transported and stored when lifted vertically. The second embodiment, which is useful as a hopper for trash or other loose bulk material, has a pivotally mounted hopper on a base with an inclined front wall and a bracket that hooks onto a receiving box, permitting the operator to partially withdraw the fork of the lift fork, releasing the pivoted end of the hopper so that raising the fork will tip the hopper, dumping its contents into the receiving.

Bryant, U.S. Pat. No. 4,838,752 describes a safety mechanism for forklift attachment, prevents the premature dumping of a container residing on the attachment in situations where the container is not adequately secured to the attachment because of operator error or non-uniform size containers.

Best et al., U.S. Pat. No. 5,054,150 describes a sweeping machine which includes a debris collection hopper and filter assembly which is readily attached to the lift bars of a conventional forklift so as tot be manipulated both horizontally and vertically by the forklift and which is mounted thereto so as to float relative to he forklift in order to follow the contour of the surface being swept.

Lazenby, U.S. Pat. No. 4,798,510 describes a concrete bucket assembly, which is rigidly mounted for vertical, tilting, and rotational movement for a forklift vehicle. The concrete bucket is provided with upper and lower ball and socket assemblies. The lower ball and socket assembly secures the bucket to the extending fork of the vertically movable frame of the forklift truck. The upper ball and socket assembly secures the bucket, at the top thereof, to an arm, which extends from and is pivotally secured to the vertically movable frame of the forklift vehicle. The hydraulic system of the vehicle is used to move a closure member at the funnel shaped bottom of the bucket and to also control movement of a chute at the bottom of the bucket.

Hoppey, U.S. Pat. No. 3,971,485 describes an attachment for a conventional forklift for enabling the lifting and pivoting of elongated containers such as barrels is disclosed, including a base frame means having connection means for connection to the forks of an operated container clamp jaw members on the frame, and hydraulic tilt means for pivoting the container clamp jaws to enable pouring from a container.

Jobmann et al., U.S. Pat. No. 5,655,873 describes a drum lifting attachments for allowing forklift trucks to be able to raise and lower 55-gallon storage drums. A first embodiment includes a drum lifting attachment having two pairs of arcuate lifting arms positioned side-by-side to allow for lifting two 55-gallon plastic drums simultaneously. This embodiment includes a pair of arcuate arms for each drum. A rotatable rectangular flap can fold-down over the portion of the side-by side connection between the two pairs of arcuate arms in order to allow for the lifting of a different diameter sized drum. Optionally, the fold-down flap can have arcuate shaped sides. Optionally, plural flaps of increasing sizes can be folded down to adjust for the different diameter drums. A second embodiment includes a fork lifting attachment that includes four sets of arcuate arms for allowing four 55-gallon drums to be able to be lifted simultaneously. The drums to be lifted in include standard 55-gallon metal drums, 55-gallon conical drums and drum sizes of varying diameters. Each of the embodiments includes attachment couplers for hooking about the standard parallel forks of a fork lifting truck. The drum lifting attachments can be formed from galvanized steel, stainless steel, and combinations thereof. The lifting attachments are able to lift and lower two drums and our drums simultaneously.

Eaglesham, U.S. Pat. No. 4,987,631 describes a cleaning attachment to fit a forklift truck for cleaning substantially vertical surfaces. The attachment includes a mounting frame fitted with spaced-apart hollow sleeves to receive the forks of the forklift truck and thereby connect the frame with the hydraulic hoist for vertical movement. An elongated scrubbing element is mounted with a support frame connected with the mounting frame by spaced-apart parallel arms. The arms are pivotally mounted with the mounting frame and support frame respectively to provide reciprocating movement of the scrubbing element toward and away from the surface to be cleaned. In use the scrubbing element is traversed over the surface to be cleaned by vertical movement of the hoist and horizontal movement of the forklift.

The prior art teaches front loading equipment of various types and also, a front loading bucket attachment for a forklift truck (Badder). However, the prior art does not teach that such a forklift attachment can be configured, with respect to its structure, in such a simplified manner making it very inexpensive, relatively light in weight and easy to use. The present invention fulfills these needs and provides further related advantages as described in the following summary.

SUMMARY OF THE INVENTION

The present invention teaches certain benefits in construction and use which give rise to the objectives described below.

The present invention provides an attachment for a forklift truck comprising an articulated bucket, hydraulic ram and pallet-like platform for engagement with the forks of the truck. By using the existing hydraulic lines of the truck the bucket may be actuated between a horizontal and a dump positions. The ram is positioned medially on the bucket and a gusset plate is employed within the bucket to enable the forces to be distributed to the bucket plates in an even manner.

A primary objective of the present invention is to provide a forklift truck attachment having advantages not taught by the prior art.

Another objective is to provide such an attachment that is enabled for using hydraulic controls of the forklift truck for bucket actuation.

A further objective is to provide such an attachment that is easily attached to the forks of the truck so as to be quickly utilized when necessary.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention, a front-end loading apparatus 10 utilizing a bucket attached to a forklift for scooping, carrying and dumping materials such as dirt, snow, sand and any number of other materials. The loading apparatus 10 comprises the three primary elements, as described below.

Figure 1:
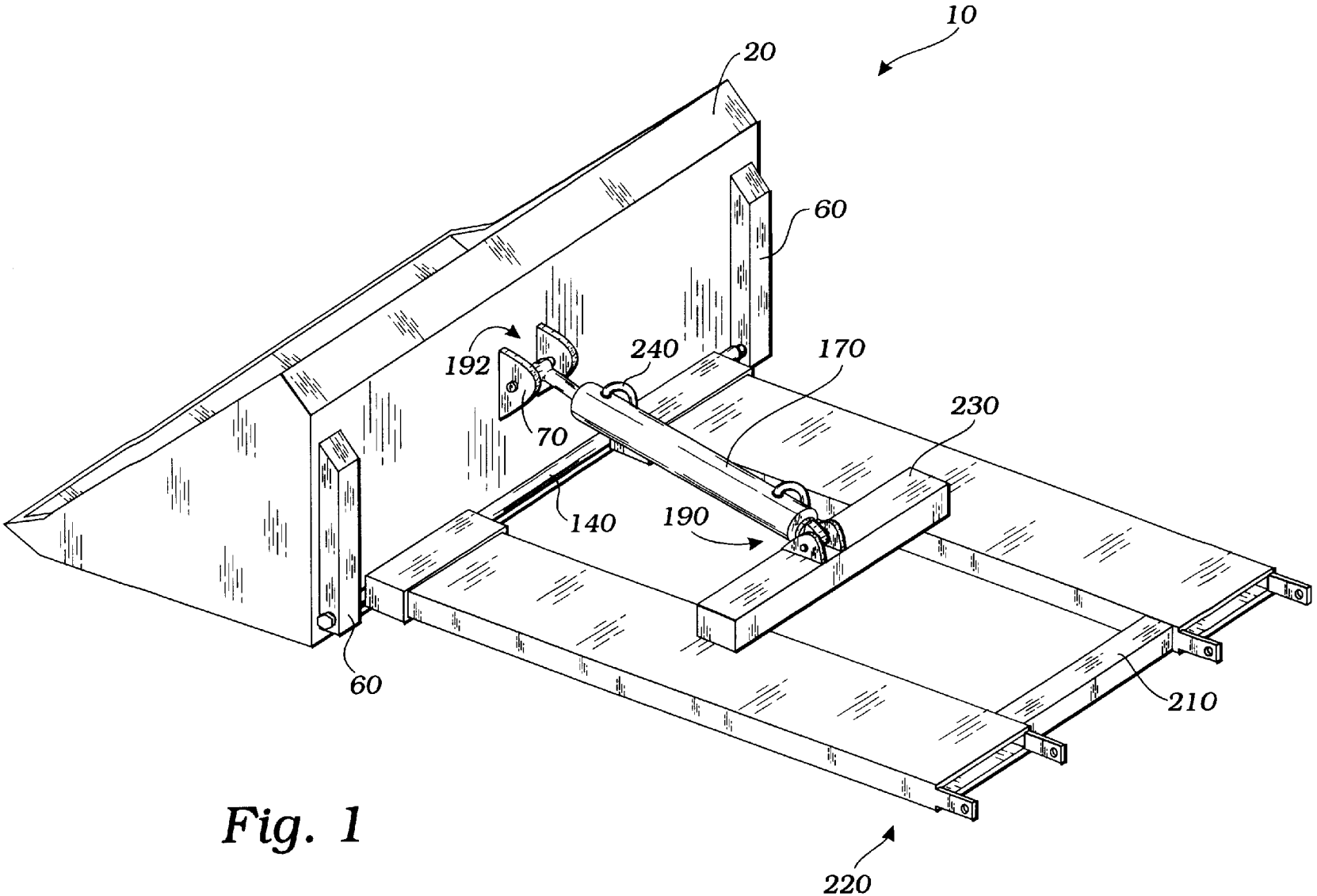
FIG. 1 is a perspective view of the preferred embodiment of the present invention illustrating the position of a hydraulic ram.
Figure 2:
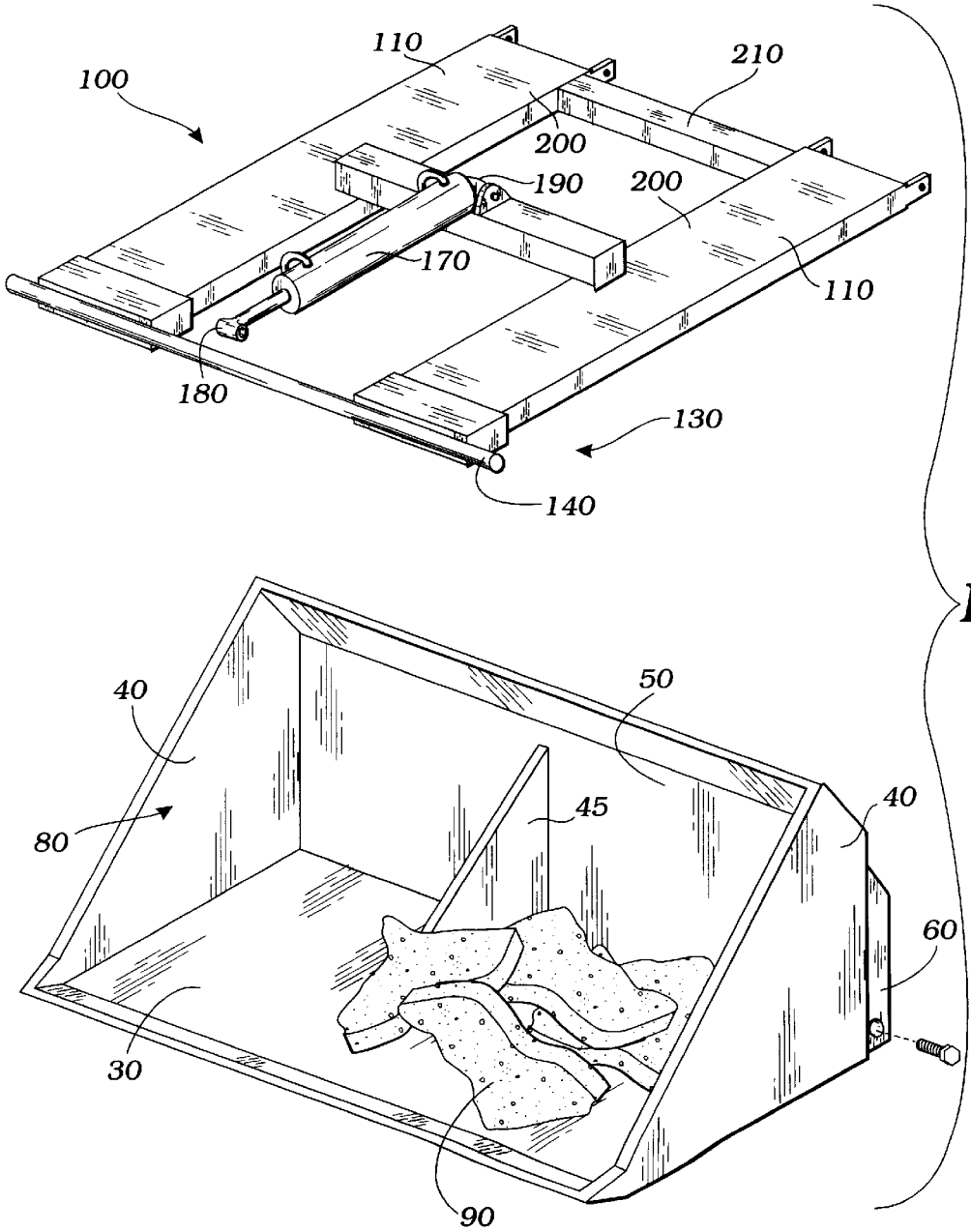
FIG. 2 is an exploded perspective front view thereof.

The loading apparatus 10 comprises bucket 20 having, as an integral assembly, a bottom plate 30, a pair of spaced apart side plates 40 positioned laterally to the bottom plate 20, and a rear plate 50 (FIG. 2). The rear plate 50 provides a bucket pivoting means receiving means 60 (FIG. 2) and a ramming means attaching means 70 (FIG. 1). The plates define a scooping volume 80 enabled for scooping, carrying and dumping a payload 90 (FIG. 2). The bucket 20 includes a gusset plate 45 for strengthening the bucket medially. On both the vertical and horizontal planes, the gusset plate 45 provides a means for strengthening the bucket at the point where bucket positioning forces are applied as defined below.

Figure 3:
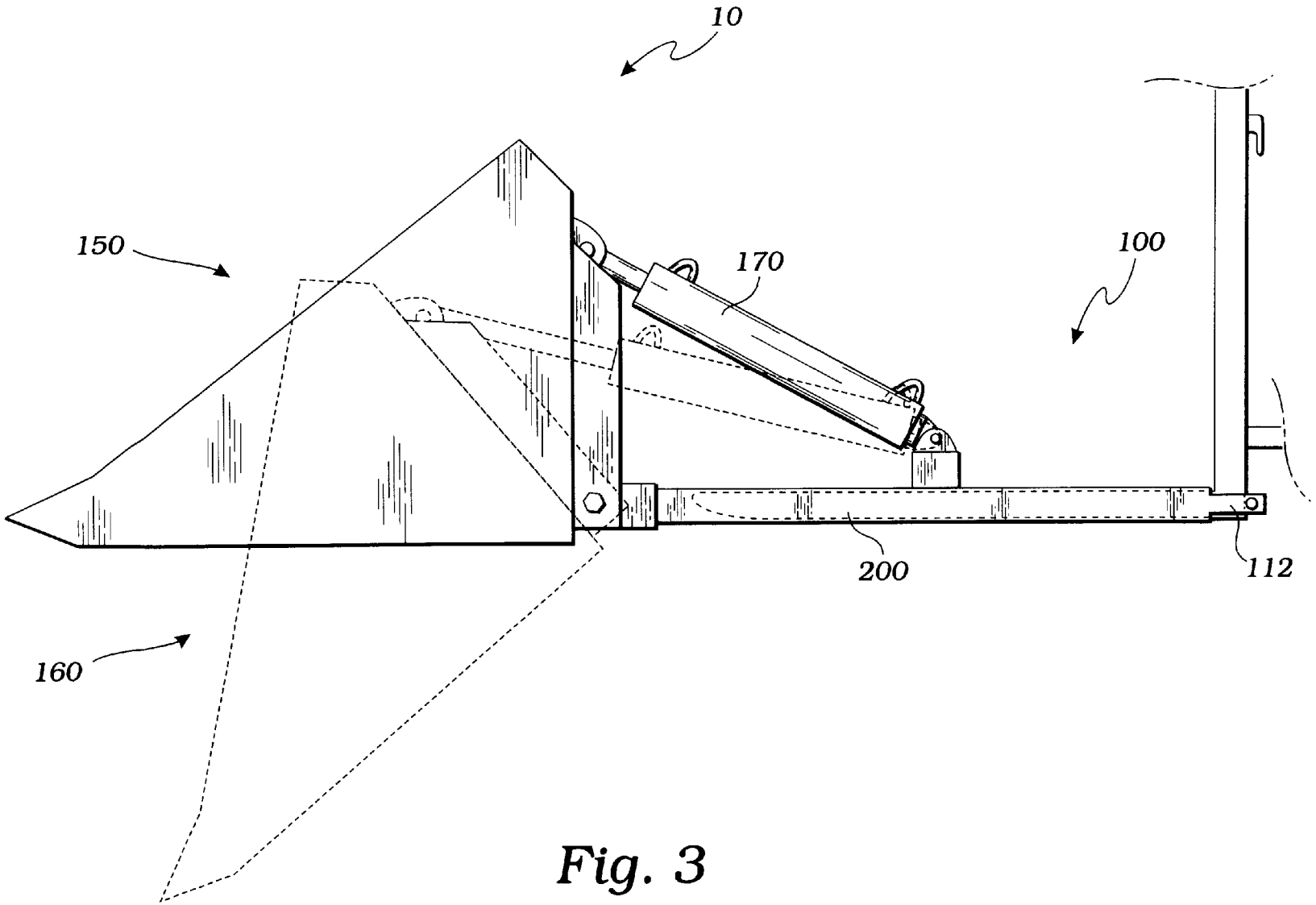
FIG. 3 is a side elevational view thereof illustrating bucket manipulation and fork engagement.

The loading apparatus 10 (FIG. 1) further comprises a fork engagement platform 100 providing a fork engaging means 110 (FIG. 2) enabled by bolting, clamping or spring action snap-on device for engagement with the forks 120 of a fork-lift truck as best shown in FIG. 3. It should be noted that the forks 120 are temporarily fixed in place within the fork engaging means 110 by bolting or quick-release device using ears 112 (FIG. 3), assuming a receiving holes are provided in corresponding positions in the forks 120. At the distal end 130 of the fork engagement platform 100, an integral bucket pivoting means 140 enables, by the use of bolts, steel rod(s) or such, pivotal engagement with the bucket pivoting means receiving means 60. In this manner, the bucket 20 is enabled for rotation between a level attitude 150, as shown in FIG. 3, for scooping the payload from a horizontal surface (not shown), and a dumping attitude 160 for dumping the payload.

In the preferred embodiment, the fork engaging means 110 of the fork engagement platform 100 comprises a pair of spaced apart fork sleeves 200 (FIG. 2) joined by the bucket pivoting means 140 at the distal end 130 and by a stabilizing strut means 210 at the proximal end 220 as shown in FIG. 1.

Still further the apparatus comprises a ramming means 170, such as a hydraulic cylinder, pneumatic cylinder, or possibly an electric motor or other known motive device, pivotally engaged with the fork engagement platform 100 at a first end 190 of the ramming means 170, which in the preferred embodiment is the end of a cylinder housing thereof. It is pivotally engaged with the bucket 20 at the second end 180 in a position opposing the gusset plate 45. The common positioning of the gusset plate 45 and the ramming means 170 is considered to be highly inventive in that it enables a considerably lighter construction in light of the prior art and in light of use with a forklift truck. This saving in weight and strengthened construction results in improved performance in payload and hauling capability. The ramming means 170 is enabled for linear extension and contraction by hydraulic pressure so as to rotate the bucket for positioning it between the level attitude 150 and the dump-attitude 160. This enables the loading apparatus 10 to dump loads 90 into designated areas, and to elevate and dump the load 90 over retaining walls and other barriers (not shown in the figures).

The ramming means 170 necessarily provides a ramming means mounting strut means 230 positioned integrally between the fork sleeves 200, as is clearly shown in FIG. 2. Preferably, if the ramming means 170 is a single hydraulic cylinder, as in the preferred embodiment, it is positioned medially on the mounting strut 230 so that the force applied to the bucket 20 is centered on the bucket. If more than one cylinder is employed, they would preferably be spaced apart symmetically on the bucket 20 for the same reason.

The apparatus further provides a hydraulic pressure actuating conduit means 240 (FIG. 1) enabled by applying hydraulic, e.g., pneumatic, pressure, for actuating the ramming means 170 for enabling bucket motion in accordance with the following description of invention use. The hydraulic lines of the forklift are attached to the hydraulic ram 170 using the forklift side shift lines normally used to move the forklift assembly horizontally left or right in relation to the forklift truck as is well known to those of skill in the art. These lines are therefore not used for lateral motion of the loading apparatus.

The preferred method of operation of the present invention is to position the forklift truck (not shown) with the bucket 20 in the level attitude 150 (as shown in FIG. 3) and at a necessary height and relationship to the materials being moved. The operator then follows four steps in utilizing the present invention.

First, the operator drives the truck and bucket directly into the materials to be moved, filling the bucket 20 with the payload 90. Second, the operator backs the forklift truck and bucket 20 away from the materials being moved and proceeds to the point of destination. The destination point could be positioned in a truck bed, in a designated dumping area, or behind a wall or other barrier, etc. Third, the operator positions the bucket 20 over the destination point, by raising or lowering it to accommodate the height of the destination point. Fourth, the operator positions the bucket 20 in the dump-attitude 160 (FIG. 3) to release the materials and may expedite such dumping by moving the bucket 20 rapidly between level attitude 150 and dump-attitude 160. The process is repeated until the materials are relocated to the destination point. When the project is complete, the operator repositions the bucket 20 in the level attitude 150, positioning the forklift forks 120 at ground level for storage and in readiness for the next project. At this point, the bucket 20 may be removed by withdrawing the bolts or other retaining device from ears 112, and the hydraulic lines 240 of the forklift truck so as to restore the forklift truck to its original configuration and ready to be used in its more traditional role of lifting and moving pallets or other warehouse and loading dock operations.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A loading apparatus comprising:

a bucket having, as an integral assembly, a bottom plate, a pair of spaced apart side plates positioned laterally to the bottom plate, a medially positioned gusset plate and a rear plate, the rear plate providing a bucket pivoting means receiving means comprising a pair of spaced apart vertically oriented reinforcement blocks integral with the rear plate, and a ramming means attaching means, the plates defining a scooping volume enabled for scooping, carrying and dumping a payload;

a fork engagement platform providing a fork engagement means enabled for engagement with the forks of a fork-lift truck, and at a distal end of the fork engagement platform, an integral bucket pivoting means comprising a straight rod extending laterally outwardly on opposing sides of the fork engagement means and enabled for pivotal engagement with the vertically oriented reinforcement blocks of the bucket pivoting means receiving means at opposing terminal ends of the straight rod, wherein the bucket is enabled for rotation between a level attitude for scooping the payload from a horizontal surface, and a dump attitude for dumping the payload;

a ramming means pivotally engaged with the fork engagement platform at a first end of the ramming means, and further, pivotally engaged with the bucket at a second end thereof at a medial position on the bucket opposing the gusset plate; the ramming means enabled for linear extension and contraction so as to rotate the bucket about the ramming means attaching means for positioning the bucket between the level attitude and the dump attitude.

2. The apparatus of claim 1 wherein the fork receiving means of the fork engagement platform comprises a pair of spaced apart fork sleeves joined by the bucket pivoting means at the distal end thereof and by a stabilizing strut means at a proximal end thereof.

3. The apparatus of claim 1 wherein the ramming means further provides a ramming means mounting strut means positioned integrally between the fork engagement means, the ramming means positioned medially thereon.

4. The apparatus of claim 1 further providing an air pressure actuating conduit means enabled for actuating the ramming means for enabling bucket motion.

* * * * *